US006186478B1

(12) United States Patent
Hamada et al.

(10) Patent No.: US 6,186,478 B1
(45) **Date of Patent: *Feb. 13, 2001**

(54) AL ALLOY POPPET VALVE

(75) Inventors: Akihiro Hamada, Machida; Hiroaki Asanuma, Fujisawa, both of (JP)

(73) Assignee: Fuji Oozx, Inc. (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 18 days.

(21) Appl. No.: 09/259,742

(22) Filed: Feb. 25, 1999

(30) Foreign Application Priority Data

Mar. 3, 1998 (JP) ..... 10-050850
Mar. 3, 1998 (JP) ..... 10-050857

(51) Int. Cl.[7] ..... F16K 31/00
(52) U.S. Cl. ..... 251/368; 123/188.3
(58) Field of Search ..... 251/368; 123/188.3

(56) References Cited

U.S. PATENT DOCUMENTS 4,838,936 * 6/1989 Akechi ..... 75/249
5,076,866 * 12/1991 Koike et al. ..... 123/188.3
5,409,661 * 4/1995 Imahashi et al. ..... 419/10

FOREIGN PATENT DOCUMENTS 0 566 098 10/1993 (EP) .

OTHER PUBLICATIONS

European Search Report Communications for XS 9930142110 MA "Abstract/Zusammenfassung/Abrege" No. 99301421.6 (Modified by the Search Division) for Fuji Oozx Inc.

US XP–002104156 "Aluminium" by J.E. Hatch, 1984 "American Society For Metals", No. 143820, p. 355–p. 360.

* cited by examiner

*Primary Examiner*—John Fox

(57) ABSTRACT

An Al alloy poppet valve is used in an internal combustion engine and has a valve head and a valve stem. At least the valve head is made of non-heat-treatable Al alloy in which ceramic particles such as oxide and carbide are uniformly dispersed, thereby increasing wear resistance and durability.

11 Claims, 2 Drawing Sheets

AL ALLOY POPPET VALVE

BACKGROUND OF THE INVENTION

The present invention relates to an Al alloy poppet valve, and especially to an Al alloy poppet valve that provides high strength and high wear resistance.

An intake poppet valve that has relatively low heat load is made of Al alloy to decrease inertia mass in a valve operating system, thereby decreasing engine performance. However, Al alloy valve has low mechanical strength and wear resistance, thereby decreasing durability and reliability.

A poppet valve is made of metal matrix composite (MMC) in which ceramic particles or whiskers are added to heat-treatable Al alloy such as JIS-2000 Alloy (Al-Cu-Mg), JIS-4000 alloy (Al-Si), JIS-6000 alloy (Al-Mg-Si) or JIS-7000 alloy (Al-Zn-Mg-Cu) under Japanese Industrial Standards (JIS). The poppet valve is subjected to melting such as T6 treatment under JIS to increase strength and wear resistance.

In the poppet valve ceramic particles are added to heat-treatable Al alloy and subjected to melting, working temperature of a valve head 250 to 300° C. is higher than solution treatment temperature of 150 to 200° C. when it is used as an intake valve for an engine, so that hardness of the poppet valve increased by solution treatment gradually decreases, and a valve face which requires wear resistance is worn early so that durability is decreased.

To solve the problems, a metal that has wear resistance is padded, or a hardened layer is formed by an alloy which contains reinforcement element. However, the valve head must be heated to temperature above solution treatment temperature, and strength of the whole valve head is decreased.

SUMMARY OF THE INVENTION

To overcome the disadvantage, it is an object to provide a wear-resistant durable Al alloy poppet valve to prevent decrease in hardness at working temperature of an engine.

According to the present invention, there is provided an Al alloy poppet valve which comprises a valve head and a valve stem, at least said valve head being made of material of non-heat-treatable Al alloy, ceramic particles being uniformly dispersed in the material The material is strengthened by the ceramic particles to increase mechanical strength and to minimize decrease in hardness owing to working temperature of an engine, thereby increasing durability and reliability.

BRIEF DESCRIPTION OF THE DRAWINGS

The features and advantages of the invention will become more apparent from the following description with respect to embodiments as shown in appended drawings wherein.

DETAILED DESCRIPTION OF PREFERRED EMBODIMENTS

Figure 1:
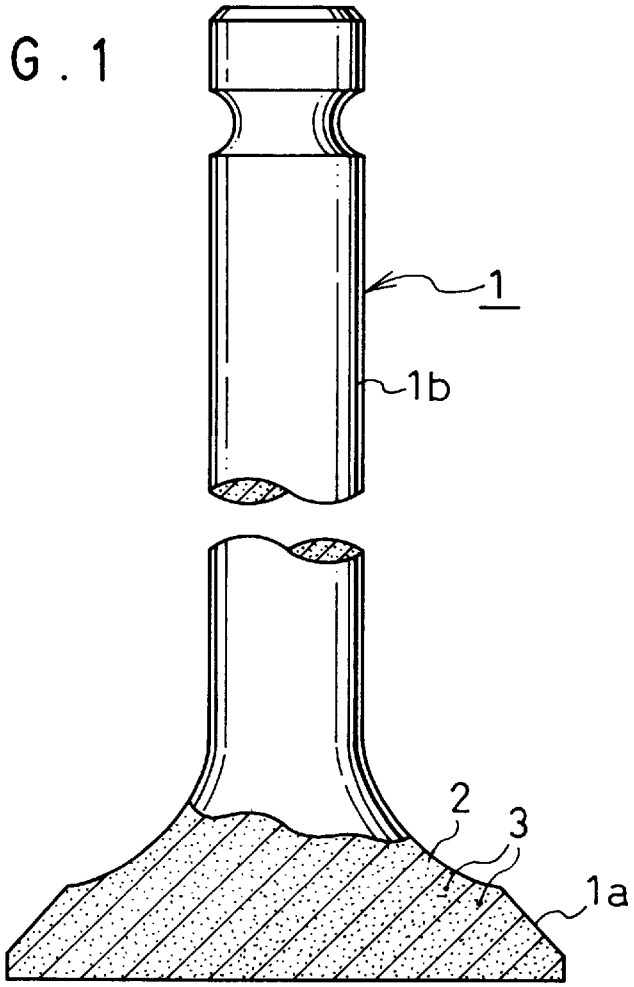
FIG. 1 is a partially cut-out front view which illustrates one embodiment of the present invention.
Figure 2:
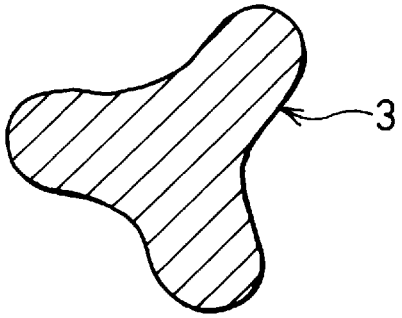
FIG. 2 is a view which illustrates a shape of a section of a ceramic particle.

FIG. 1 illustrates an intake poppet valve 1 in which ceramic particles 3 or whisker is uniformly dispersed in material 2.

Al alloy as the material 2 may be preferably selected from JIS-5000, such as JIS-5083 which contains 4 to 4.9% by weight of Mg, 0.4% by weight of Si, 0.4% by weight of Fe, 0.4 to 1.0% by weight of Mn, 0.25% by weight of Zn, 0.15% by weight of Ti, 0.05 to 0.25% by weight of Cr, 0.1% by weight of Cu, and balance of Al and inevitable impurities. JIS is an abbreviation of Japanese Industrial Standards. The material 2 is kept for a long time at temperature such as 250° C., and hardness is not varied.

As the ceramic particles 3, there is a mixture of one or more ceramics of oxide, carbide, nitride and boride such as $Al_2O_3$, $ZrO_2$, SiC, NbC, $Si_3N_4$, BN, CrC and TiB, having average diameter of about 3 $\mu$m (1 to 5 $\mu$m). Why the average particle diameter is about 3 $\mu$m is that manufacturing is difficult if it is less than 3 $\mu$m and that uniform strength is not obtained by largeness in organization if it is more than 3 $\mu$m.

To form the poppet valve, there is formed metal matrix composite (MMC) which contains the above ceramic particles at 15 to 20% by volume in JIS-5000 Al alloy as above, the ceramic particles containing ones having average diameter of 3 $\mu$m at 70 to 80%. Then, the material is heated to suitable temperature, inserted into a die for molding a valve, and forged in hot or warm pressing. The poppet valve 1 where the ceramic particles 3 are dispersed in the material 2 as shown in FIG. 1 is obtained.

In the poppet valve I in the foregoing embodiment, non-heat treatable JIS-5000 Al alloy is employed, and the ceramic particles 3 are dispersed in the material 2, so that decrease in hardness or strength owing to working temperature is very low, thereby improving wear resistance of a valve face 1*a* or valve stem 1*b*.

Hardening is expected by valve movement during forging and engine operation to improve strength of the valve head, thereby providing sufficient durability as an intake valve.

To employ high speed and high load engine, a hard metal is padded on the valve face la or an alloy or hardness layer which comprises the material 2 and reinforcement metal such as Ni, Cu, Cr and Mo may be formed to increase wear resistance of the valve face 1*a* further. Even if the material 2 is heated during wear resistance treatment, there is no decrease in hardness or strength of the valve head as made in Al alloy.

The present invention is not limited to the above embodiment. In the foregoing embodiment, the whole valve is made of JIS-5000 non-heat-treatable Al alloy, but only a valve head which is subjected to high heat load may be made of the foregoing JIS-5000 Al alloy and a valve stem which is subjected to low heat load is made of ordinary heat-treatable Al alloy, so that both may be combined.

For example, the shape of the particles 3 can be determined depending on unevenness of the section of the particle 3.

When the sectional area of the particle 3 is "A", the circumference is "L" and the ratio of the circumference to its diameter is "π", unevenness "X" will be given by the following formula:

$$X=L^2/A\times 1/\pi\times 1/4$$

Figure 3:
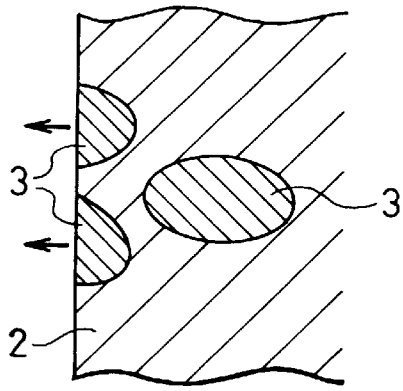
FIG. 3 is an enlarged sectional view in which rounded ceramic particles are contained.
Figure 4:
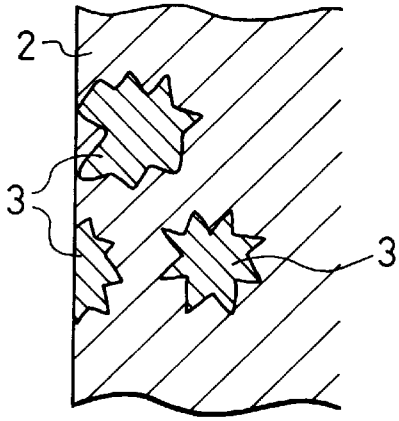
FIG. 4 is an enlarged sectional view in which highly uneven ceramic particles are contained.

If the section of the particle is a circle, "X" would be 1. The larger unevenness is, the larger the circumference is. "X"

becomes larger than 1. The particle 3 used in the present invention has 1.3 to 4.0 as unevenness. If "X" is less than 1.3, the particles 3 are rounded as shown in FIG. 3, and are likely to fall out of the surface of the material 2 to lose wear resistance. On the contrary, if "X" is more than 4.0, the particles 3 are unlikely to fall out as shown in FIG. 4, but projections on the outer circumferential surface are sharpened to increase attackability to others.

To form the poppet valve, ceramic particles 3 having average diameter of about 3 $\mu$m at 70 to 80% in JIS-5000 Al alloy are contained at 15 to 20% by volume to manufacture material, which is inserted into a die for forming a valve and made by hot or warm pressing. As shown in FIG. 1, the ceramic particles 3 are uniformly dispersed in the material 2 to obtain the poppet valve 1.

In the intake poppet valve of the foregoing embodiment, non-heat-treatable JIS-5000 Al alloy is used as the material 2, and the ceramic particles 3 are dispersed therein, thereby minimizing decrease in hardness or strength owing to working temperature of an engine and increasing mechanical strength of the whole valve to improve wear resistance of the valve face la and the valve stem 1*b*.

Figure 5:
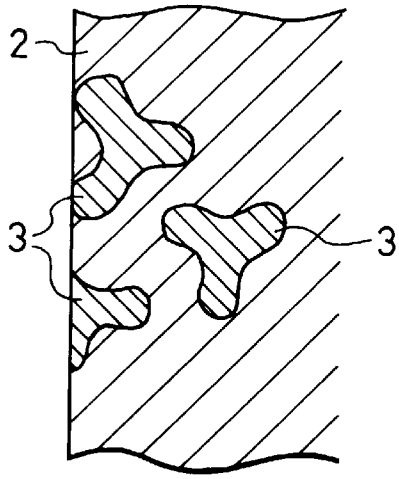
FIG. 5 is an enlarged sectional view in which suitable uneven ceramic particles are contained in the present invention.

The ceramic particle 3 has a section having rounded unevenness as shown in FIG. 5, thereby increasing bonding force with the material 2 and preventing falling-out. A sharpened projection is not exposed over the surface layer of the material 2, thereby decreasing attackability to others.

The foregoing merely relate to embodiments of the present invention. Various changes and modifications may be made by person skilled in the art without departing from the scope of claims wherein:

What is claimed is:

1. An Al alloy poppet valve which comprises a valve head and a valve stem, at least said valve head being made of material of non-heat treatable Al alloy, ceramic particles being unformly dispersed in the material.

2. The Al alloy poppet valve as claimed in claim 1 wherein the ceramic particles have a profile of rounded unevenness.

3. The Al alloy poppet valve as claimed in claim 1 wherein the material is made of JIS-5000 Al alloy.

4. The Al alloy poppet valve as claimed in claim 1 wherein the ceramic particles are made of a compound selected from the group of oxide, carbide, nitride and boride, or a mixture of two or more compounds selected from said group.

5. The Al alloy poppet valve as claimed in claim 4 wherein the ceramic particles are made of a compound selected from the group of oxide, carbide, nitride and boride.

6. The Al alloy poppet valve as claimed in claim 4 wherein the oxide is $Al_2O_3$ or $ZrO_2$.

7. The Al alloy poppet valve as claimed in claim 4 wherein the carbide is SiC, NbC or CrC.

8. The Al alloy poppet valve as claimed in claim 4 wherein the nitride is $Si_3N_4$ or BN.

9. The Al alloy poppet valve as claimed in claim 4 wherein the boride is $TiB_2$.

10. The Al alloy poppet valve as claimed in claim 1 wherein an average diameter of the ceramic particles is about 3 $\mu$m.

11. The Al alloy poppet valve as claimed in claim 1 wherein the ceramic particles are contained in the material at 15 to 20% by volume.

* * * * *